US010460654B2

(12) United States Patent
Ishii

(10) Patent No.: US 10,460,654 B2
(45) Date of Patent: Oct. 29, 2019

(54) SEMICONDUCTOR DEVICE AND DISPLAY APPARATUS

(71) Applicant: JOLED INC., Tokyo (JP)

(72) Inventor: Hiroaki Ishii, Tokyo (JP)

(73) Assignee: JOLED INC., Tokyo (JP)

( * ) Notice: Subject to any disclaimer, the term of this patent is extended or adjusted under 35 U.S.C. 154(b) by 124 days.

(21) Appl. No.: 15/123,087

(22) PCT Filed: Dec. 17, 2014

(86) PCT No.: PCT/JP2014/006303
§ 371 (c)(1),
(2) Date: Sep. 1, 2016

(87) PCT Pub. No.: WO2015/132833
PCT Pub. Date: Sep. 11, 2015

(65) Prior Publication Data

US 2017/0076662 A1 Mar. 16, 2017

(30) Foreign Application Priority Data

Mar. 6, 2014 (JP) ..... 2014-044322

(51) Int. Cl.
*G09G 3/3225* (2016.01)
*G09G 5/00* (2006.01)
(Continued)

(52) U.S. Cl.
CPC ..... *G09G 3/3225* (2013.01); *G09G 3/3266* (2013.01); *G09G 3/3275* (2013.01);
(Continued)

(58) Field of Classification Search
CPC ... G09G 3/3225; G09G 3/3275; G09G 3/3266
See application file for complete search history.

(56) References Cited

U.S. PATENT DOCUMENTS 5,031,118 A * 7/1991 Morizot ..... G09G 5/006 345/213
5,926,174 A * 7/1999 Shibamiya ..... G06F 3/1475 345/213

(Continued)

FOREIGN PATENT DOCUMENTS

JP 2002-156950 5/2002
JP 2004-538523 12/2004

(Continued)

OTHER PUBLICATIONS

International Search Report (ISR) in International Pat. Appl. No. PCT/JP2014/006303, dated Feb. 17, 2015.

*Primary Examiner* — Nitin Patel
*Assistant Examiner* — Robert M Stone
(74) *Attorney, Agent, or Firm* — Greenblum & Bernstein, P.L.C.

(57) ABSTRACT

A semiconductor device includes: a receiving circuit which receives communication frames each transmitted with a first period or a second period that are different from each other and including a synchronization code and data; a logic circuit which has a first operation state in which the received communication frames are each processed as data other than a digital video signal, and a second operation state in which the received communication frames are each processed as the digital video signal; a detecting circuit which detects the synchronization code from each of the received communication frames; a measuring circuit which measures a period of the detected synchronization code; and a determining circuit which determines the measured period. The logic circuit substantially makes a transition to the first operation state or the second operation state according to a result of the determining.

9 Claims, 8 Drawing Sheets

(51) Int. Cl.
*G09G 5/12* (2006.01)
*G09G 3/3266* (2016.01)
*G09G 3/3275* (2016.01)

(52) U.S. Cl.
CPC ..... *G09G 5/006* (2013.01); *G09G 5/12* (2013.01); *G09G 2310/08* (2013.01); *G09G 2320/0252* (2013.01); *G09G 2370/08* (2013.01); *G09G 2370/14* (2013.01)

(56) References Cited

U.S. PATENT DOCUMENTS 6,046,737 A * 4/2000 Nakamura ..... G09G 3/2092 345/213
7,113,163 B2 9/2006 Nitta et al.
7,796,198 B2 9/2010 Ikeda et al.
8,884,934 B2 11/2014 Jeon et al.
2002/0057238 A1 5/2002 Nitta et al.
2003/0103058 A1 6/2003 Elliott et al.
2006/0214927 A1 9/2006 Ikeda et al.
2006/0279523 A1 12/2006 Nitta et al.
2007/0052857 A1* 3/2007 Song ..... G06F 3/1431 348/565
2008/0297511 A1* 12/2008 Chou ..... G09G 5/005 345/428
2011/0242066 A1 10/2011 Jeon et al.
2012/0038497 A1* 2/2012 Ku ..... H04N 5/04 341/100
2012/0075188 A1* 3/2012 Kwa ..... G09G 3/2096 345/168
2013/0057763 A1* 3/2013 Cha ..... G09G 5/006 348/554
2014/0111360 A1* 4/2014 Gu ..... H03M 9/00 341/100
2014/0118330 A1* 5/2014 Lee ..... G09G 3/2096 345/212
2015/0243253 A1* 8/2015 Sone ..... G09G 3/2096 345/209
2016/0196781 A1* 7/2016 Tanaka ..... G09G 3/3648 345/691

FOREIGN PATENT DOCUMENTS

JP 2006-235151 9/2006
JP 2008-076989 4/2008
JP 2009-042659 2/2009
JP 2011-221487 11/2011
WO 03/015066 2/2003

* cited by examiner

SEMICONDUCTOR DEVICE AND DISPLAY APPARATUS

TECHNICAL FIELD

The present disclosure relates to a semiconductor device which controls display of a display panel, and to a display apparatus.

BACKGROUND ART

A flat panel display apparatus such as a liquid-crystal display apparatus and an organic electroluminescent (EL) display apparatus includes a control circuit that is referred to as a timing controller (TCON). The display apparatus includes a display panel substrate including a plurality of pixel circuits arranged in rows and columns, a row-drive circuit which drives the plurality of pixel circuits on a row basis, a column-drive circuit which drives the plurality of pixel circuits on a column basis, the TCON, etc. The TCON controls display of a display panel substrate by supplying, on the basis of an inputted video signal, the row-drive circuit and the column-drive circuit with various kinds of control signals and the video signal.

The number of display pixels, display frame rates, etc. of a display panel have increased with the increase in size and definition of the display panel. A semiconductor device used as the above-described TCON is required to perform high-speed transmission ranging from several Gbps to several tens of Gbps, for inputting of an uncompressed video signal.

For example, as described in Patent Literature (PTL) 1 (FIG. 33), a low voltage differential signal (LVDS) which is suitable to the high-speed transmission is employed. In addition, according to PTL 2 (FIG. 52A and FIG. 52B), a video signal is transmitted to a TCON using the LVDS.

CITATION LIST

Patent Literature

[PTL 1] Japanese Unexamined Patent Application Publication No. 2002-156950

[PTL 2] Japanese Unexamined Patent Application Publication No. 2004-538523

SUMMARY OF INVENTION

Technical Problem

However, according to the conventional techniques, there is a possibility of receiving data other than a video signal, immediately after an operation mode of a semiconductor device on a receiver side has changed to an operation mode for receiving a video signal. As a result, the data other than a video signal is processed accidentally as the video signal, leading possibly to a problem, for example, of image disturbance in a display panel on which the semiconductor device performs display control. In addition, there is also a possibility of a problem caused by processing a video signal as data other than a video signal, immediately after the operation mode has changed to an operation mode for receiving data other than a video signal.

An object of the present disclosure is to provide a semiconductor device and a display apparatus which prevent, in communication between semiconductor devices, a problem caused by a gap of timing of a state transition between the semiconductor devices.

Solution to Problem

In order to solve the above-described problems, the semiconductor device according to the present disclosure is a semiconductor device which controls display of a display panel, the semiconductor device including: a receiving circuit which receives a plurality of communication frames each transmitted with a first period or a second period and including a synchronization code and data, the first period and the second period being different from each other; a logic circuit which has a first operation state in which the plurality of communication frames received by the receiving circuit are each processed as data other than a digital video signal, and a second operation state in which the plurality of communication frames received by the receiving circuit are each processed as the digital video signal; a detecting circuit which detects the synchronization code from each of the plurality of communication frames received by the receiving circuit; a measuring circuit which measures a period of the synchronization code detected in each of the plurality of communication frames; and a determining circuit which determines whether the period measured is the first period or the second period, wherein the logic circuit substantially makes a transition to the first operation state or the second operation state according to a result of the determining performed by the determining circuit.

Advantageous Effects of Invention

According to the present disclosure, a semiconductor device and a display apparatus which prevent, in communication between semiconductor devices, an adverse effect caused by a gap of timing of a state transition between the semiconductor devices.

Figure 1:
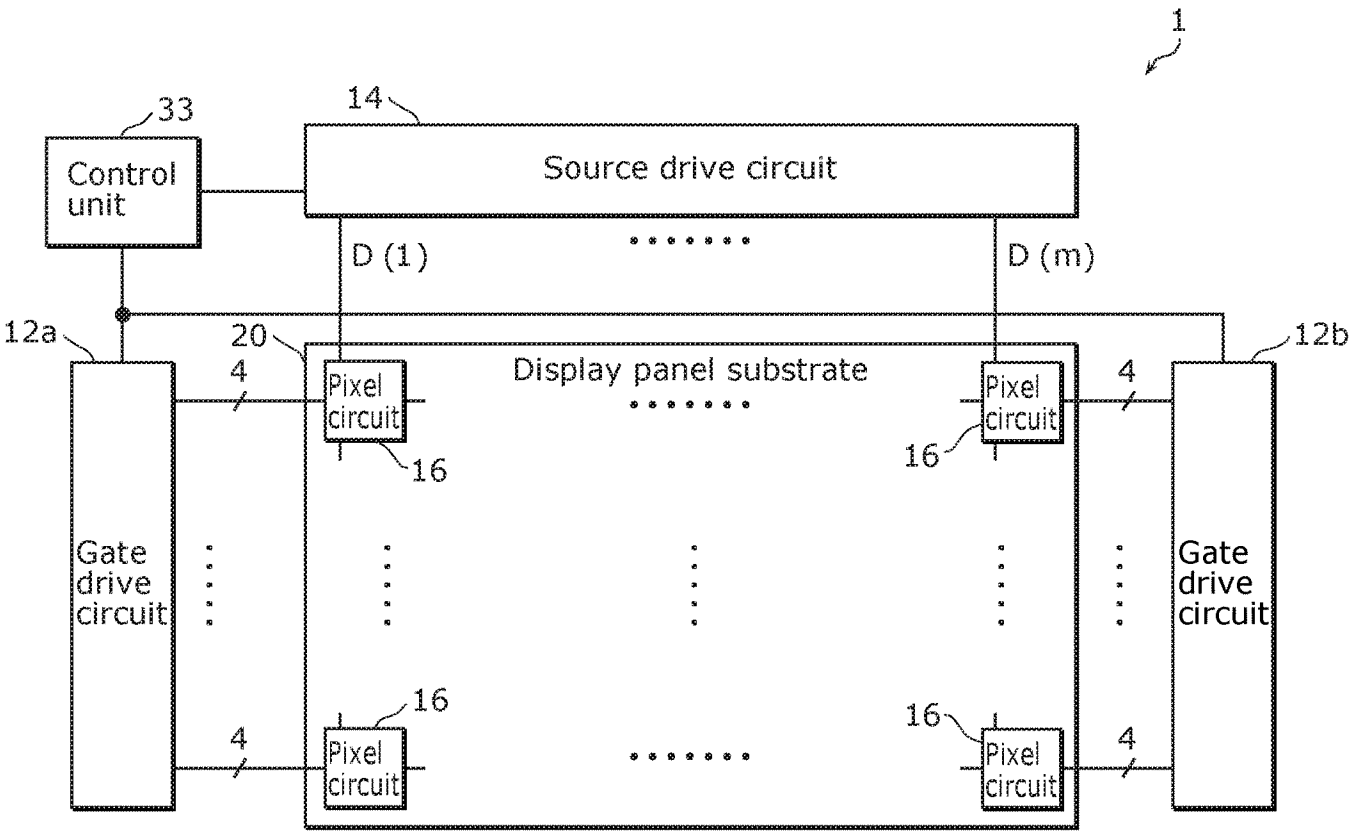
FIG. 1 is a block diagram illustrating a configuration example of a display apparatus according to an embodiment.

DESCRIPTION OF EMBODIMENTS (Underlying Knowledge Forming the Basis of the Present Invention)

The inventor found the following problems with the conventional high-speed transmission described in the "Background Art" section.

As described above, there is a possibility of receiving, as a video signal, data other than the video signal, immediately after an operation mode of a semiconductor device on a receiver side has changed to an operation mode for receiving a video signal, leading possibly to image disturbance.

With a system in which, for example, a microcomputer instructs each of the semiconductor device on the transmitter side and the semiconductor device on the receiver side to switch operation modes, there is a possibility of receiving erroneous data when the operation modes has changed as described above, if there is a gap of timing of the instruction. More specifically, erroneous data is possibly received when the instruction from the microcomputer arrives at the semiconductor device on the receiver side prior to arriving at the semiconductor device on the transmitter side. In particular, compared with a high transmission rate of several Gbps between the semiconductor devices, the operation frequency of a microcomputer is significantly slow, approximately several hundreds of MHz, for example. A transmission rate of a transmission interface between the semiconductor devices is high enough to transmit a small amount of data in a gap of instructions from the microcomputer.

In order to address the above-described problem, it is conceivable that the state transition is made while performing handshaking between the semiconductor devices. More specifically, in performing communication between the semiconductor devices having the high-speed transmission interface, each of the semiconductor devices transmits a synchronization establishing signal to the microcomputer. Upon receiving the synchronization establishing signal, the microcomputer instructs each of the semiconductor devices to make a transition to an operation mode for receiving a video signal. Upon receiving this instruction, each of the semiconductor devices makes a state transition while mutually performing the handshaking. This allows the timing of the state transition between two semiconductor devices to be matched, even when the instruction arrives at the semiconductor devices with different timing. However, this necessitates separately providing a communication line for handshaking between the semiconductor devices, posing a different problem of cost increase.

In view of the above, the present disclosure provides a semiconductor device and a display apparatus which prevent, in communication between the semiconductor devices, an adverse effect caused by a gap of timing of a state transition between the semiconductor devices.

Embodiment

Hereinafter, an embodiment is discussed in detail with reference to the drawings as necessary. However, description that is too detailed will be omitted in some cases. For example, there are instances where detailed description of well-known matter and redundant description of substantially identical components are omitted. This is for the purpose of preventing the following description from being unnecessarily redundant and facilitating understanding of those skilled in the art.

It should be noted that the accompanying Drawings and subsequent description are provided by the inventors to allow a person of ordinary skill in the art to sufficiently understand the present disclosure, and are thus not intended to limit the scope of the subject matter recited in the Claims.

Hereinafter, an embodiment is described with reference to the drawings.

[1. Configuration of a Display Apparatus]

FIG. 1 is a block diagram illustrating a configuration example of a display apparatus according to an embodiment. A display apparatus 1 illustrated in FIG. 1 includes a display panel substrate 20, gate drive circuits 12*a* and 12*b*, a source drive circuit 14, and a control unit 33. The display apparatus 1 is a flat panel display apparatus, such as an organic EL display apparatus, a liquid-crystal display apparatus, a plasma display apparatus, etc. In the following description, the display apparatus 1 is described as the organic EL display apparatus.

The display panel substrate 20 includes a plurality of pixel circuits 16 arranged in rows and columns. The plurality of pixel circuits 16 are disposed in the display panel substrate 20 through semiconductor processes. A material of the display panel substrate 20 is glass or resin (for example, acrylic).

The plurality of pixel circuits 16 are arranged in n rows and m columns. Each of n and m differs according to a size and a definition of the display screen. For example, in the case where pixel circuits 16 corresponding to RGB three primary colors and having a high definition (HD) are disposed adjacent to each other in a row, n rows are at least 1080 rows and m columns are at least 1920×3 columns.

The pixel circuits 16 each have an organic EL element as a light-emitting element, and includes a light-emitting pixel of one of the RGB three primary colors.

The gate drive circuit 12*a* is also referred to as a row-drive circuit, and scans a gate signal on a row basis of the pixel circuits 16. Here, the gate signal is a signal provided to the gate of each of the switching transistors in the pixel circuit 16, and controls on and off of the switching transistor.

The gate drive circuit 12*b* has the same configuration as the gate drive circuit 12*a*.

The gate drive circuits 12*a* and 12*b* drive the same gate signal with the same timing from the left side of the display panel substrate 20 and from the opposing right side of the display panel substrate 20. This is for the purpose of reducing signal deterioration due to wiring capacitance of each of the signal lines in a large display apparatus. In a small display apparatus, only one of the gate drive circuits 12*a* and 12*b* is sufficient.

The source drive circuit 14 is also referred to as a column-drive circuit, and supplies signal lines D(1) to D(m) with voltages each indicating luminance of a corresponding one of the pixels that belong to the respective columns, on the basis of a video signal provided from the control unit 33. More specifically, the source drive circuit 14 supplies the signal lines D(1) to D(m) with voltages each indicating luminance of a corresponding one of the pixels. The supplied voltage is applied to the pixel circuit 16 that belongs to a row selected in the scanning performed by the gate drive circuit 12*a* and 12*b*. In addition, the video signal provided from the control unit 33 to the source drive circuit 14 is inputted as, for example, digital serial data for each of the RGB three primary colors, converted to parallel data on a row basis in the source drive circuit 14, further converted to analogue data on a column basis, and outputted to the signal lines D(1) to D(m).

It should be noted that, although only a single source drive circuit 14 is illustrated in FIG. 1, two source drive circuits may be disposed above and below the display panel substrate 20 and output the same signal with the same timing in a large display apparatus.

The control unit 33 controls an overall operation of the display apparatus 1. More specifically, according to a vertical synchronization signal and a horizontal synchronization signal of a video signal provided from outside, the control unit 33 instructs the gate drive circuits 12*a* and 12*b* to start scanning, and supplies the source drive circuit 14 with the above-described digital serial data.

[1-1. Configuration of the Control Unit]

Next, the configuration of the control unit 33 shall be described.

Figure 2:
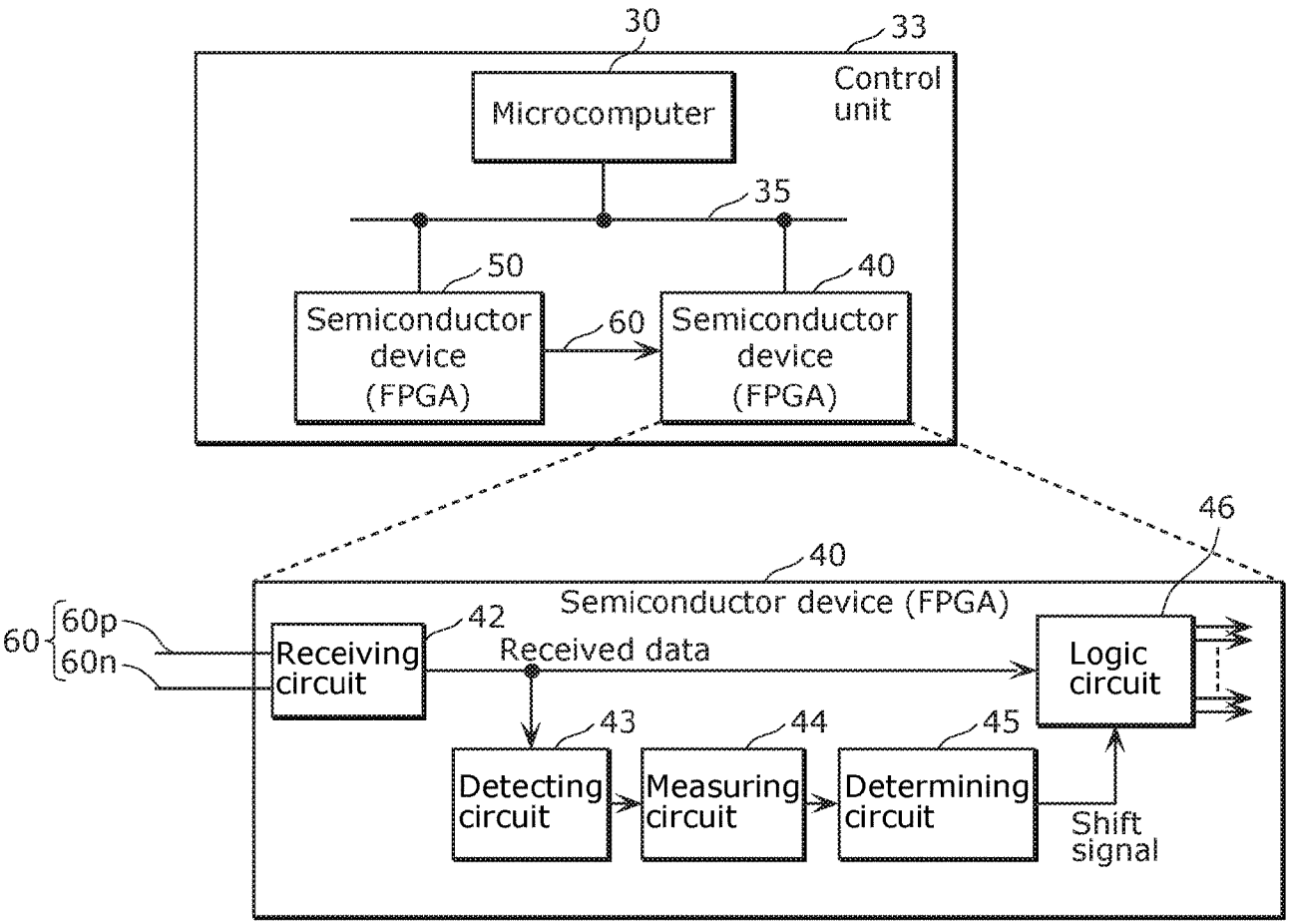
FIG. 2 is a block diagram illustrating a configuration example of a control unit according to the embodiment.

FIG. 2 is a block diagram illustrating a configuration example of the control unit 33. As illustrated in the upper part of the diagram, the control unit 33 includes a microcomputer 30, a semiconductor device 40 that is a first semiconductor chip, and a semiconductor device 50 that is a second semiconductor chip, and serves as a timing controller (TCON).

In addition, according to the present embodiment, in a unidirectional communication from the semiconductor device 50 that is the second semiconductor chip to the semiconductor device 40 that is the first semiconductor chip, the semiconductor device 50 transmits communication frames of different periods according to the operation state of the semiconductor device 50, and the semiconductor device 40 makes a transition of an operation state of the semiconductor device 40 according to the period of the received communication frame.

The microcomputer 30 controls operations of the semiconductor device 40 and the semiconductor device 50. More specifically, the microcomputer 30 transmits a notification instructing a transition of the operation state (or operation mode) of the semiconductor device 40 and the semiconductor device 50.

The semiconductor device 40 is a semiconductor chip, and configured as, for example, a field programmable gate array (FPGA) or an application specific integrated circuit (ASIC). The semiconductor device 40 supplies various control signals to the gate drive circuits 12*a* and 12*b* and the source drive circuit 14 for controlling display of the display panel substrate 20. In addition, the semiconductor device 40 has at least two operation states of a first operation state and a second operation state. More specifically, the semiconductor device 40 processes, as data other than a digital video signal, a communication frame received via a transmission line 60 from the semiconductor device 50, in the first operation state. In addition, the semiconductor device 40 processes, as a digital video signal, a communication frame received via the transmission line 60 from the semiconductor device 50, in the second operation state. The semiconductor device 40 makes a transition of the operation state according to the notification from the microcomputer 30 and the period of the received communication frame.

The semiconductor device 50 is a semiconductor chip, and configured as, for example, a field programmable gate array (FPGA) or an application specific integrated circuit (ASIC). The semiconductor device 50 has at least two operation states of a first operation state and a second operation state. More specifically, the semiconductor device 50 transmits data other than a digital video signal, as a communication frame of a period T1, to the semiconductor device 40 via the transmission line 60, in the first operation state. In addition, the semiconductor device 50 transmits a digital video signal as a communication frame of a period T2, to the semiconductor device 40 via the transmission line 60, in the second operation state. The semiconductor device 50 makes a transition of the operation state according to the notification from the microcomputer 30.

The control unit 33 is configured as described above.

[1-2. Configuration of the Semiconductor Device on the Receiver Side]

As illustrated in the lower part of FIG. 2, the semiconductor device 40 includes a receiving circuit 42, a detecting circuit 43, a measuring circuit 44, a determining circuit 45, a logic circuit 46, and a transmission line 60.

The receiving circuit 42 receives a communication frame transmitted from the semiconductor device 50 via the transmission line 60, with either one of a first period T1 and a second period T2 which are different from each other. The communication frame includes a synchronization code and data. The transmission line 60 includes a pair of signal lines 60*p* and 60*n* capable of performing high-speed transmission by a low voltage differential signal (LVDS).

The detecting circuit 43 detects a synchronization code from the communication frame received by the receiving circuit 42.

The measuring circuit 44 measures a period of the synchronization code detected in a plurality of communication frames.

The determining circuit 45 determines whether the measured period is the first period T1 or the second period T2.

The logic circuit 46 has a first operation state in which the communication frame received by the receiving circuit 42 is processed as data other than a digital video signal, and a second operation state in which the communication frame received by the receiving circuit 42 is processed as a digital video signal. In addition, the logic circuit 46 makes a transition to the first operation state or the second operation state, according to a result of the determining performed by the determining circuit 45.

In this manner, the logic circuit 46 uses a period of the synchronization code as a condition for a transition of the operation state, and thus it is possible, for example, to prevent data which is not a video signal from being processed as a video signal.

[1-3. Configuration of the Communication Frame]

The following describes a configuration of the communication frame.

Figure 3:
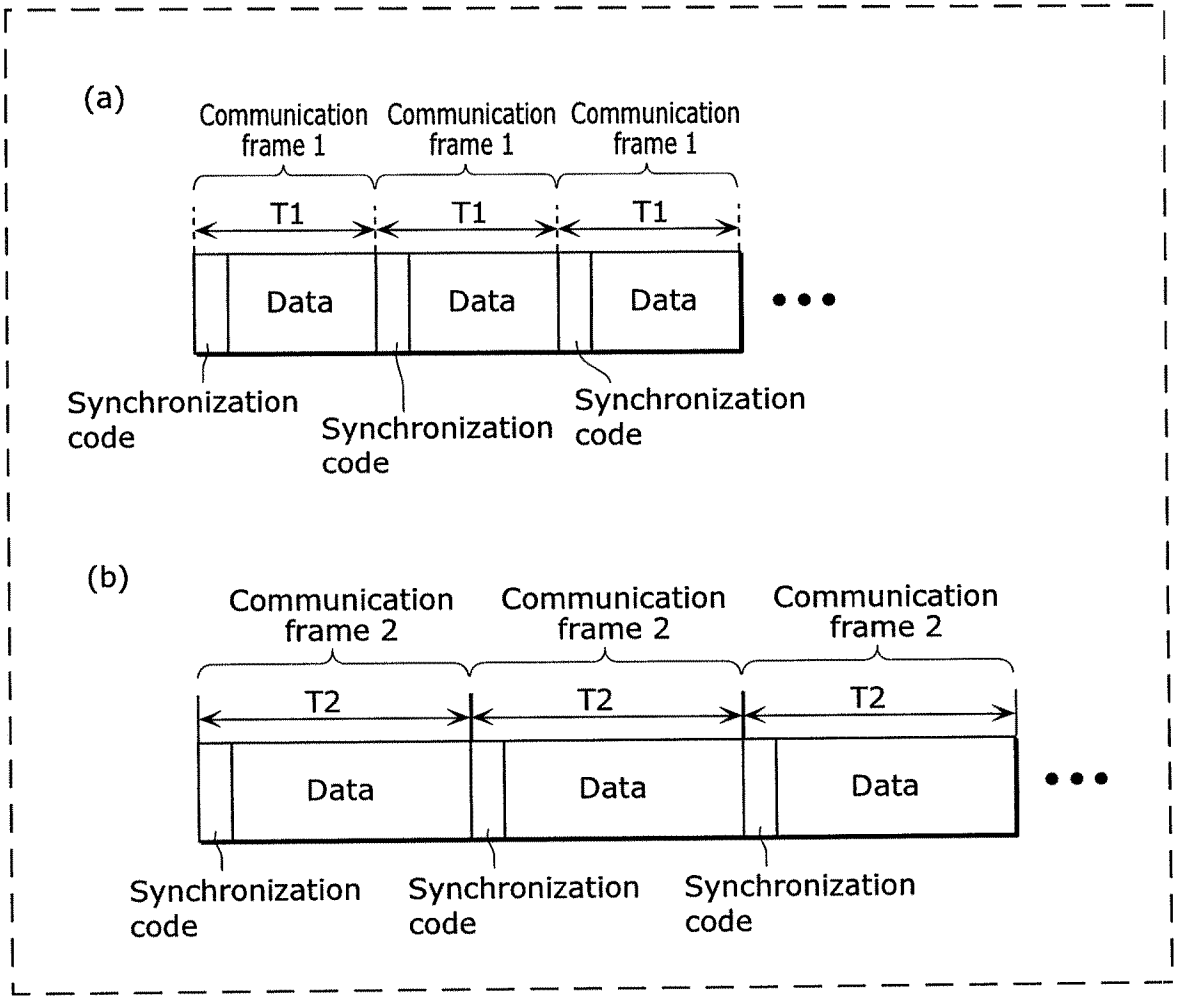
FIG. 3 is a diagram illustrating a configuration example of a communication frame transmitted to a transmission line according to the embodiment.

FIG. 3 is a diagram illustrating a configuration example of a communication frame transmitted to the transmission line 60. In FIG. 3, (a) illustrates a communication frame 1 which is transmitted from the semiconductor device 50 in the first operation state to the semiconductor device 40 via the transmission line 60. The communication frame 1 includes a synchronization code and data (more precisely, a payload to which data is attached). A period of the synchronization code in a plurality of communication frames 1 is the first period T1. Data other than a video signal, such as control data for the semiconductor device 40 and dummy data is attached to the payload of the communication frame 1

In FIG. 3, (b) illustrates a communication frame 2 which is transmitted from the semiconductor device 50 in the second operation state to the semiconductor device 40 via the transmission line 60. The communication frame 2 includes a synchronization code and data (more precisely, a payload to which data is attached). A period of the synchronization code in a plurality of communication frames 2 is the second period T2. The period T2 is greater than the period T1 in FIG. 3. However, the period T2 and the period T1 only need to be different from each other, and thus the period T2 may be smaller than the period T1. A video signal is attached to the payload of the communication frame 2. The video signal includes, for example, data indicating a pixel value of one of the RGB three primary colors, data indicating a horizontal synchronization signal, data indicating a vertical synchronization signal, etc.

The following describes operations performed by the display apparatus configured as described above.

[2. Operation]

Figure 4:
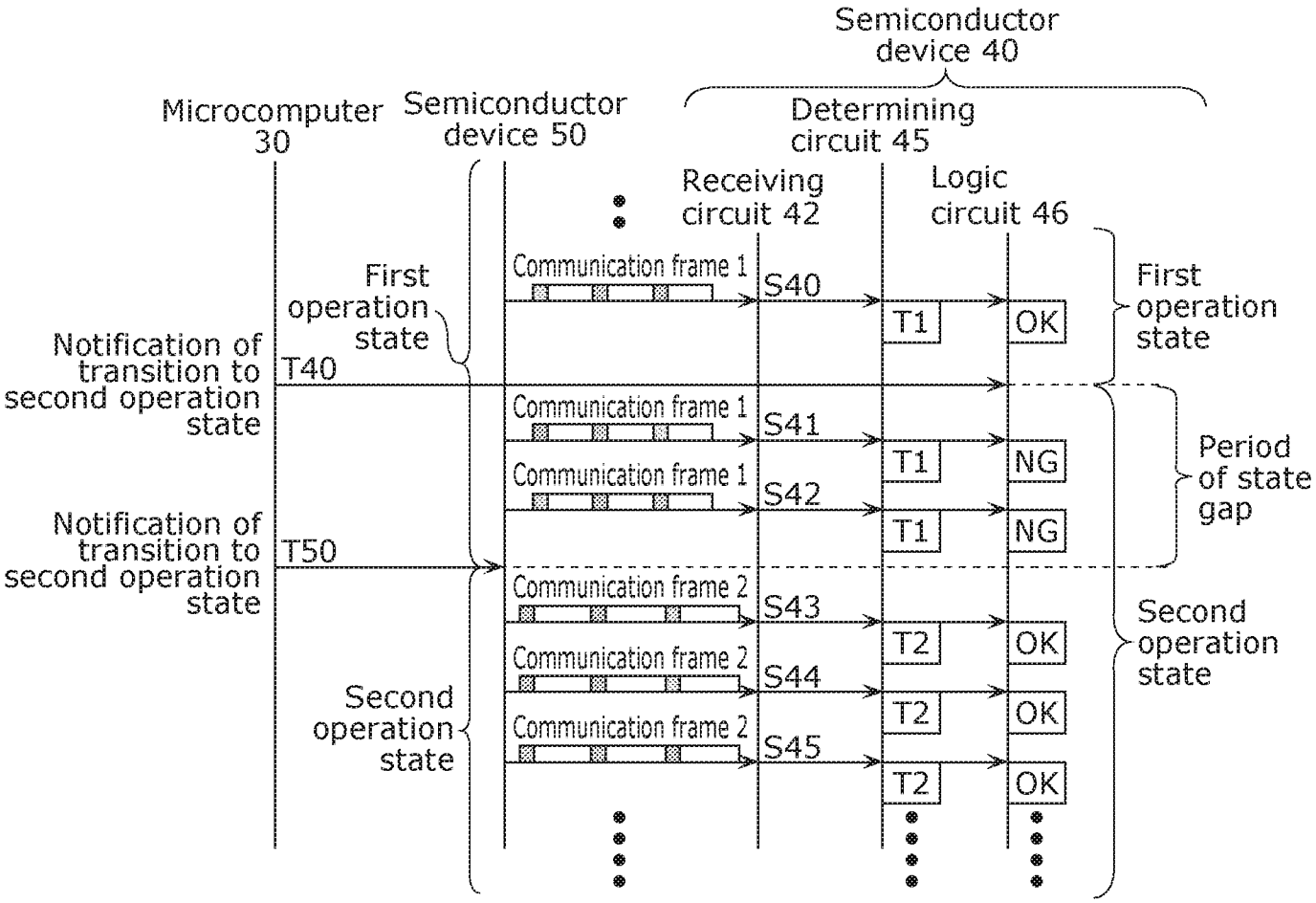
FIG. 4 is a diagram illustrating an example of a communication sequence between a microcomputer, a first semiconductor chip, and a second semiconductor chip.

FIG. 4 is a diagram illustrating an example of a communication sequence between the microcomputer 30, the second semiconductor chip (i.e., the semiconductor device 50), and the first semiconductor chip (i.e., the semiconductor device 40).

In this diagram, a line extending downward from the microcomputer 30 represents a time axis, and points further down the line occur later in time. In the same manner, the lines extending downward from the semiconductor device 50, the receiving circuit 42, the determining circuit 45, and the logic circuit 46 illustrated in the diagram represent time axes. In addition, the arrows extending laterally represent notifications from the microcomputer 30 or communication frames transmitted from the semiconductor device 50. Furthermore, the sign T1 or T2 assigned to the line extending downward from the determining circuit 45 indicates a result of determination performed by the determining circuit 45. Furthermore, the signs "OK" assigned to the line extending downward from the logic circuit 46 each indicate that the communication frames are received and processed by the logic circuit 46, and the signs "NO" each indicate that the communication frames are not received by the logic circuit 46, and discarded.

FIG. 4 illustrates an example of a communication sequence in the case where the microcomputer 30 transmits a notification (T40) instructing a transition from the first operation state to the second operation state to the semiconductor device 40, and a notification (T50) instructing a transition from the first operation state to the second operation state to the semiconductor device 50.

In a period before the notification T40 is transmitted, the semiconductor device 50 and the semiconductor device 40 each operate in the first operation state. In this period, a plurality of communication frames 1 transmitted from the semiconductor device 50 are each received by the receiving circuit 42, determined that the period is T1 by the determining circuit 45, received by the logic circuit 46, and processed as normal data.

In the period from the notification T40 to the notification T50, there is a gap of the operation state. Specifically, the semiconductor device 50 operates in the first operation state, and the semiconductor device 40 operates in the second operation state. In this period of a state gap, the plurality of communication frames 1 (S41 and S42) transmitted from the semiconductor device 50 are received by the receiving circuit 42, determined that the period is T1 by the determining circuit 45, not received by the logic circuit 46, and discarded. The plurality of communication frames 1 are discarded because the logic circuit 46 receives only the communication frames of the period T2 in the second operation state. Accordingly, it is possible to prevent the logic circuit 46 from processing, as a video signal, data which is not a video signal. More specifically, in the period of the state gap as described above, it is possible to prevent a problem caused by a mismatch in the operation state between the semiconductor device 50 and the semiconductor device 40.

In the period subsequent to the notification T50, both the semiconductor device 50 and the semiconductor device 40 operate in the second operation state. In this period, a plurality of communication frames 2 (S43 to S45) transmitted from the semiconductor device 50 are each received by the receiving circuit 42, determined that the period is T2 by the determining circuit 45, received by the logic circuit 46, and processed as a video signal. As a result, the plurality of communication frames 2 are displayed on the display panel substrate 20.

Further, another example of the communication sequence shall be described.

Figure 5:
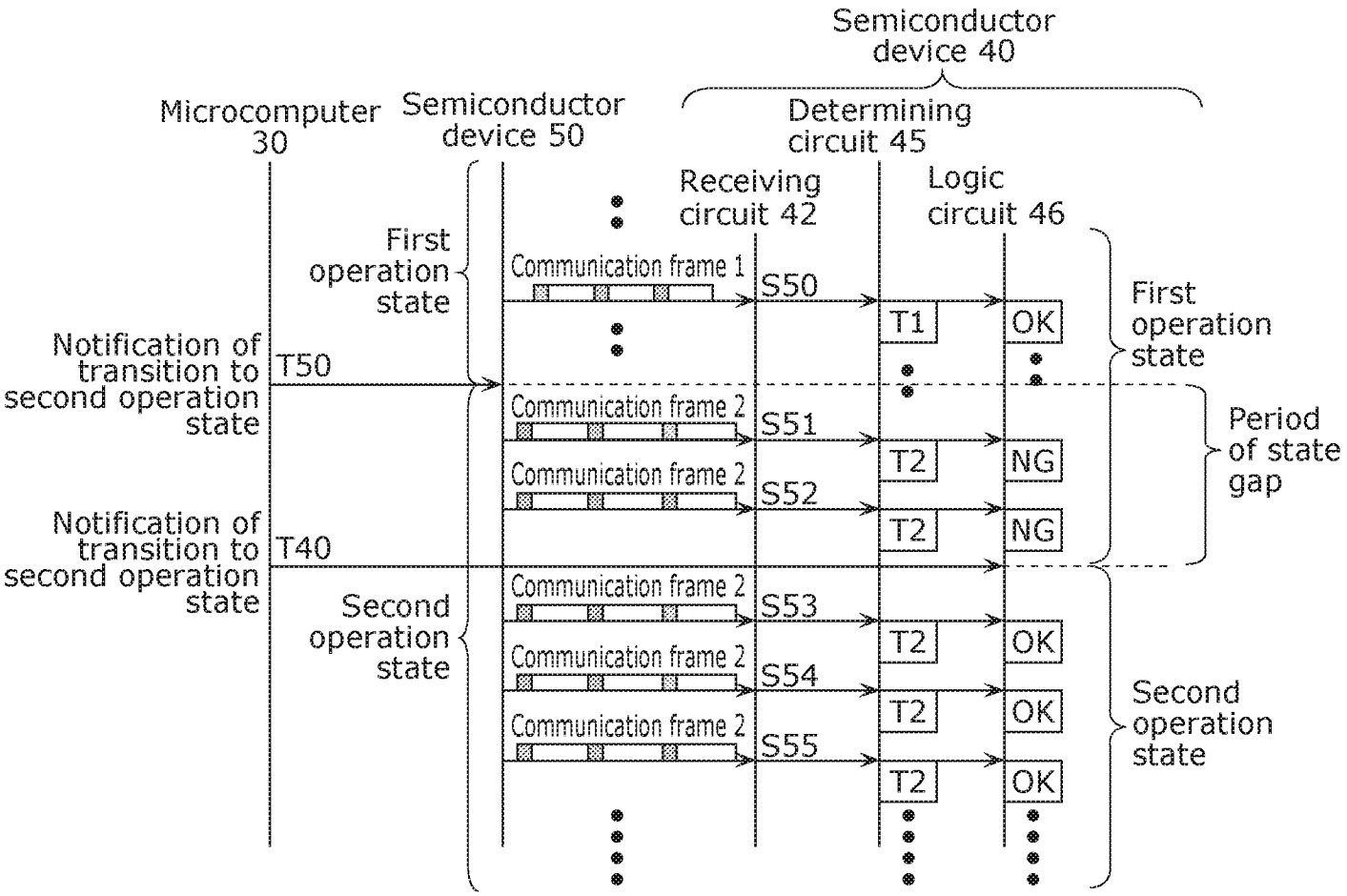
FIG. 5 is a diagram illustrating another example of the communication sequence between the microcomputer, the first semiconductor chip, and the second semiconductor chip.

FIG. 5 is a diagram illustrating another example of the communication sequence between the microcomputer 30, the first semiconductor chip (i.e., the semiconductor device 50), and the second semiconductor chip (i.e., the semiconductor device 40). FIG. 5 is different from FIG. 4 in that the microcomputer transmits the notification T50 and the notification T40 in reverse order.

In a period before the notification T50 is transmitted, both the semiconductor device 50 and the semiconductor device 40 operate in the first operation state. In this period, a plurality of communication frames 1 (S50) transmitted from the semiconductor device 50 are each received by the receiving circuit 42, determined that the period is T1 by the determining circuit 45, received by the logic circuit 46, and processed as normal data.

In the period subsequent to the notification T50 and prior to transmitting the notification T40, there is a gap of the operation state. Specifically, the semiconductor device 50 operates in the second operation state, and the semiconductor device 40 operates in the first operation state. In this period of a state gap, the plurality of communication frames 2 (S51 and S52) transmitted from the semiconductor device 50 are each received by the receiving circuit 42, determined that the period is T2 by the determining circuit 45, not received by the logic circuit 46, and discarded. The plurality of communication frames 2 are discarded because the logic circuit 46 receives only the communication frames 1 of the period T1 in the first operation state. As described above, it is possible to prevent the logic circuit 46 from receiving and processing a video signal as data other than a video signal in this period. More specifically, it is possible to prevent a problem caused by a mismatch in the operation state between the semiconductor device 50 and the semiconductor device 40.

In the period subsequent to the transmission of the notification T50, both the semiconductor device 50 and the semiconductor device 40 operate in the second operation state. In this period, a plurality of communication frames 2 (S53 to S55) transmitted from the semiconductor device 50 are each received by the receiving circuit 42, determined that the period is T2 by the determining circuit 45, received by the logic circuit 46, and processed as the video signal. As a result, the plurality of communication frames 2 are displayed on the display panel substrate 20.

As described above, even when there is a gap of timing of notification which is transmitted from the microcomputer 30, and instructs a state transition to the semiconductor device 50 and the semiconductor device 40, in other words, even when there is a mismatch in the operation state between the semiconductor device 50 on the transmitter side and the semiconductor device 40 on the receiver side, the semiconductor device 40 discards the communication frame if the period of the communication frame does not correspond to the operation state, and thus it is possible to prevent processing a video signal as data other than a video signal, and processing data other than a video signal as a video signal.

[2-1. Operation of the Semiconductor Device on the Transmitter Side]

Next, the state transition of the semiconductor device 50 on the transmitter side shall be described.

Figure 6:
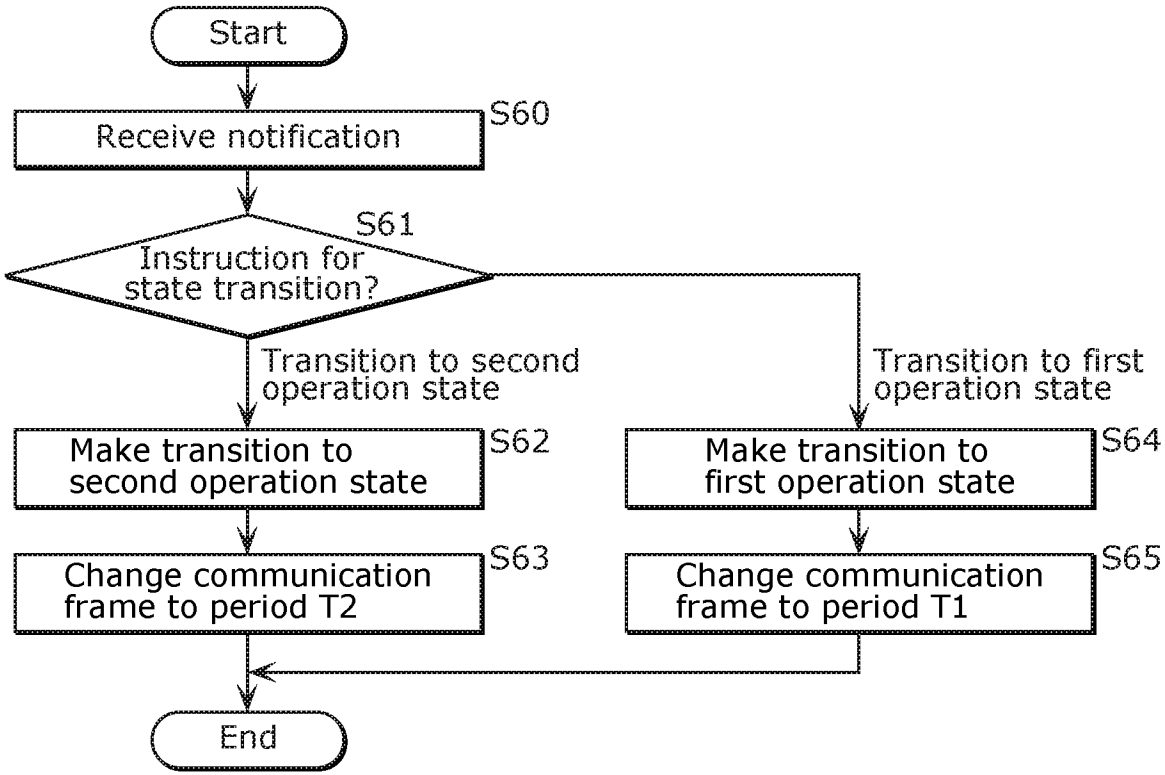
FIG. 6 is a flowchart illustrating a state transition of a semiconductor device on a transmitter side.

FIG. 6 is a flowchart illustrating the state transition of the semiconductor device 50 on the transmitter side. As illustrated in the diagram, upon receiving a notification from the microcomputer 30 (S60), the semiconductor device 50 determines whether or not the notification is an instruction for a state transition (S61), makes a transition to the second operation state when the notification instructs a transition to the second operation state (S62), and changes, to T2, a period of a communication frame to be transmitted to the transmission line 60 (563). In addition, the semiconductor device 50 makes a transition to the first operation state when the notification instructs a transition to the first operation state (S64), and changes, to T1, a period of a communication frame to be transmitted to the transmission line 60 (S65).

In the above-described example of a state transition, the semiconductor device 50 makes a transition of the operation state according to exclusively the notification from the microcomputer 30.

[2-2. Operation of the Semiconductor Device on the Receiver Side]

Next, an operation example involving a state transition of the semiconductor device 40 on the receiver side shall be described.

Figure 7:
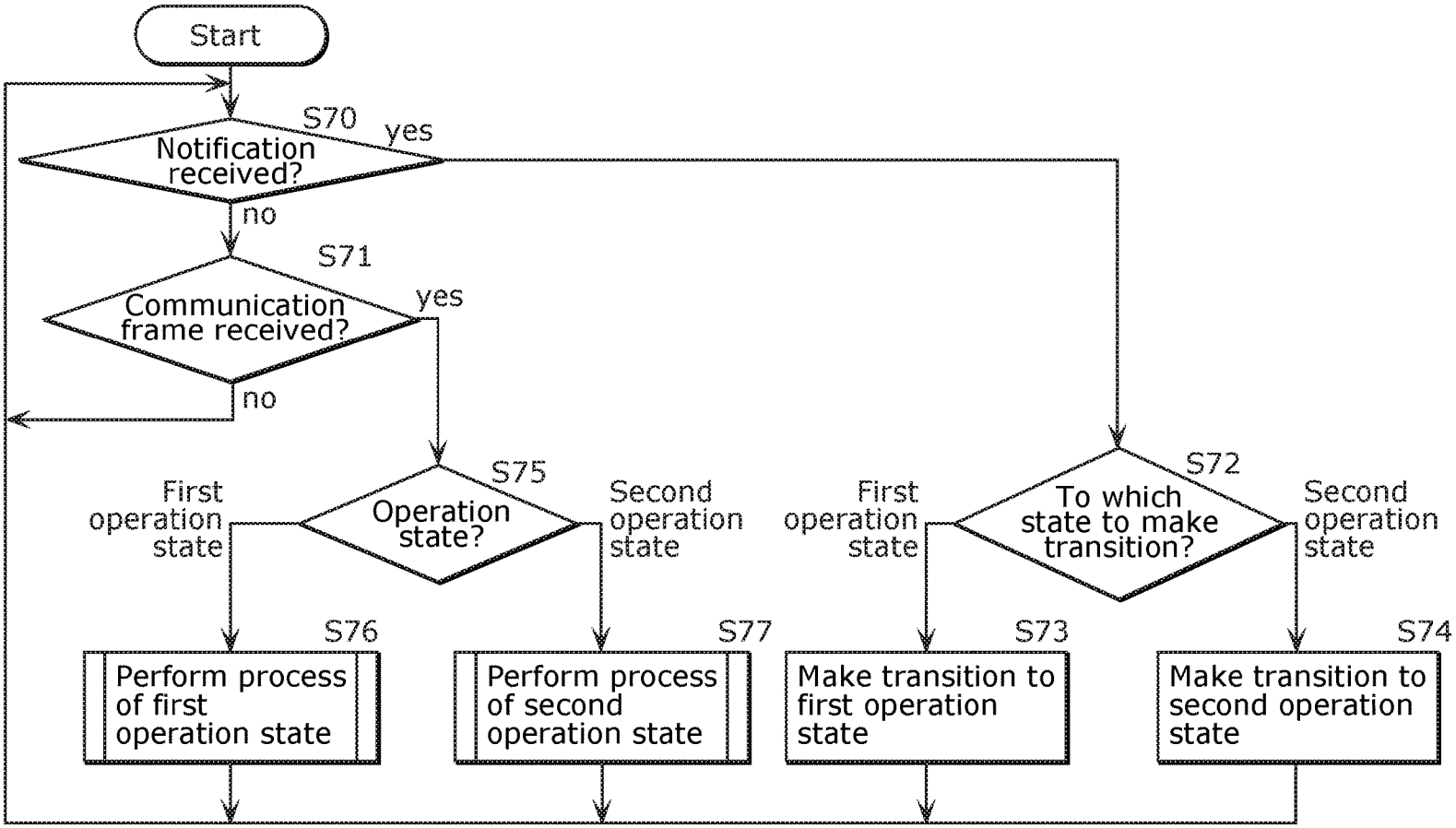
FIG. 7 is a flowchart illustrating an operation example involving a state transition of a semiconductor device on a receiver side.

FIG. 7 is a flowchart illustrating an operation example involving a state transition of the semiconductor device 40 on the receiver side. As illustrated in the diagram, the logic circuit 46 in the semiconductor device 40 first determines whether or not a notification of a state transition has been received from the microcomputer 30 (S70). When the notification has been received (yes in S70), the logic circuit 46 further determines to which state the notification instructs to make a transition (S72), makes a transition to the first operation state when the notification is determined to be an instruction of transition to the first operation state (S73), and makes a transition to the second operation state when the notification is determined to be an instruction of transition to the second operation state (S74).

In this example of the state transition, the logic circuit 46 makes a transition to the first operation state in which the communication frame is processed as data other than a video signal when the last received notification from the microcomputer 30 instructs a transition to the first operation state. In the same manner, the logic circuit 46 makes a transition to the second operation state in which the communication frame is processed as a video signal when the last received notification instructs a transition to the second operation state.

In addition, when a result is no in the above-described Step S70, the logic circuit 46 determines whether or not the receiving circuit 42 has received a communication frame (S71). The logic circuit 46 returns to the process of Step S70 when the logic circuit 46 determines that the receiving circuit 42 has not received a communication frame (no in S71), and determines a current operation state (575) when the logic circuit 46 determines that the receiving circuit 42 has received a communication frame (yes in S71). Furthermore, the logic circuit 46 performs the process of the first operation state when the logic circuit 46 determines that the current operation state is the first operation state (S76) and the logic circuit 46 performs the process of the second operation state when the logic circuit 46 determines that the current operation state is the second operation state (S77).

Next, the process of the first operation state in Step S76 and the process of the second operation state in Step S77 shall each be described.

Figure 8:
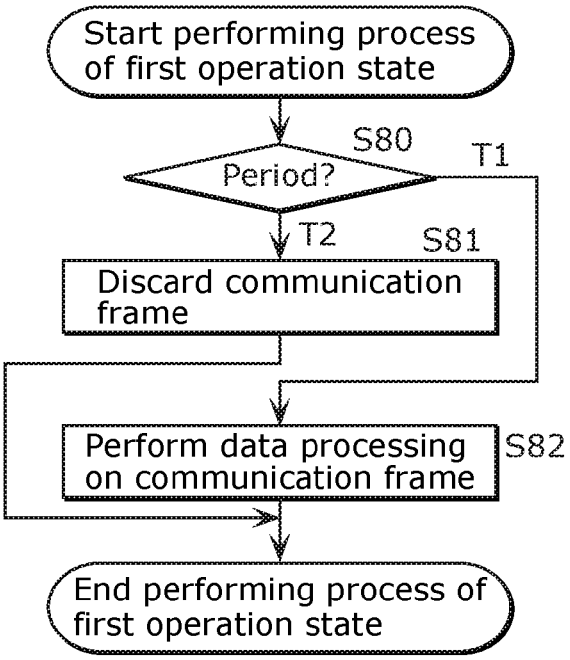
FIG. 8 is a flowchart illustrating an example of processing in a first operation state of the semiconductor device on the receiver side.

FIG. 8 is a flowchart illustrating an example of processing in the first operation state of the semiconductor device 40 on the receiver side. As illustrated in the diagram, the determining circuit 45 determines a period of the communication frame received in Step S71 (S80), and the logic circuit 46 discards the communication frame (S81) when the determined period is T2 (T2 in S80), and performs data processing on the communication frame (S82), more specifically, processes the received communication frame as data other than a digital video signal, when the determined period is T1 (T1 in S80).

Figure 9:
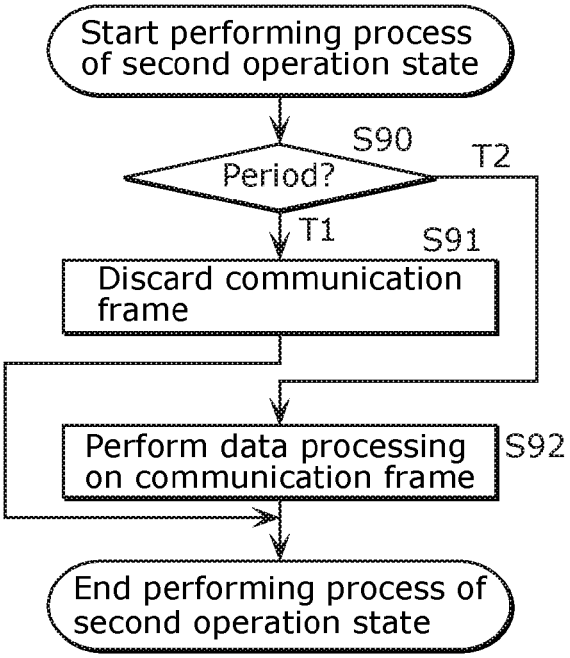
FIG. 9 is a flowchart illustrating an example of processing in a second operation state of the semiconductor device on the receiver side.

FIG. 9 is a flowchart illustrating an example of processing in the second operation state of the semiconductor device 40 on the receiver side. As illustrated in the diagram, the determining circuit 45 determines a period of a communication frame received in Step S71 (S90), and the logic circuit 46 discards the communication frame (S91) when the determined period is T1 (T1 in S90), and performs data processing on the communication frame (S92), more specifically, processes the received communication frame as a digital video signal, when the determined period is T2 (T2 in S90).

As described above, the logic circuit 46 receives and processes a communication frame when the operation state instructed by a notification from the microcomputer 30 corresponds to the period of the communication frame transmitted from the semiconductor device 50.

In addition, the logic circuit 46 discards a communication frame received by the receiving circuit 42 when the last received notification from the microcomputer 30 instructs a transition to the first operation state, and the result of determination performed by the determining circuit 45 does not indicate the first period. The above-described discarding of the communication frame corresponds to Step S81 in FIG. 8, and is carried out in a period of a state gap illustrated in FIG. 5. As described above, the period of a state gap is a period in which there is a gap in the operation state between the semiconductor device 50 on the transmitter side and the semiconductor device 40 on the receiver side. In the period of a state gap, the semiconductor device 40 on the receiver side is formally in the first operation state, but substantially not in the first operation state in that a meaningful treatment scheduled in the first operation state is not carried out. From this point of view, the period of a state gap is also a period of a state transition which is in the course of a state transition before reaching the operation state in which a substantial process is carried out. For example, as with the receiving of a communication frame in FIG. 5 (S50), the semiconductor device 40 on the receiver side is substantially the first operation state when the formal first operation state corresponds to the period T1 of the received communication frame. In this regard, the process illustrated in FIG. 8 is a process in the formal first operation state, and the process of Step S82 in FIG. 8 is a process in the substantial first operation state.

In the same manner, the logic circuit 46 discards a communication frame received by the receiving circuit 42 when the last received notification from the microcomputer 30 instructs a transition to the second operation state, and the result of determination performed by the determining circuit 45 does not indicate the second period. The above-described discarding of the communication frame corresponds to Step S91 in FIG. 9, and is carried out in a period of a state gap illustrated in FIG. 4. In the period of a state gap, the semiconductor device 40 on the receiver side is formally in the second operation state, but substantially not in the second operation state in that a meaningful treatment scheduled in the second operation state is not carried out. From this point of view, the period of a state gap is also a period of a state transition which is in the course of a state transition before reaching the operation state in which a substantial process is carried out. For example, as with the receiving of a communication frame in FIG. 4 (S43), the semiconductor device 40 on the receiver side is substantially the second operation state when the formal second operation state corresponds to the period T2 of the received communication frame. In this regard, the process illustrated in FIG. 9 is a process in the formal second operation state, and the process of Step S92 in FIG. 9 is a process in the substantial second operation state.

As described above, the logic circuit 46 discards a communication frame when the operation state instructed by a notification from the microcomputer 30 does not correspond to the period of the communication frame transmitted from the semiconductor device 50. In this manner, the logic circuit 46 is capable of preventing processing a video signal as data other than a video signal and processing data other than a video signal as a video signal, due to a gap of the timing of a notification from the microcomputer 30 or a gap of a state transition.

As described above, the semiconductor device according to an aspect of the present disclosure is the semiconductor device 40 which controls display of a display panel, and includes: a receiving circuit 42 which receives a plurality of communication frames each transmitted with a first period or a second period and including a synchronization code and data, the first period and the second period being different from each other; a logic circuit 46 which has a first operation state in which the plurality of communication frames received by the receiving circuit 42 are each processed as data other than a digital video signal, and a second operation state in which the plurality of communication frames received by the receiving circuit 42 are each processed as the digital video signal; a detecting circuit 43 which detects the synchronization code from each of the plurality of communication frames received by the receiving circuit 42; a measuring circuit 44 which measures a period of the synchronization code detected in each of the plurality of communication frames; and a determining circuit 45 which determines whether the period measured is the first period or the second period, wherein the logic circuit 46 substantially makes a transition to the first operation state or the second operation state according to a result of the determining performed by the determining circuit 45.

According to this configuration, since a state transition is made according to whether a period of the synchronization code included in the received communication frame is the first period or the second period, it is possible to prevent a false operation of processing a communication frame of the second period in the first operation state, and prevent a false operation of processing a communication frame of the first period in the second operation state.

Here, the semiconductor device 40 may receive a notification from outside. The notification instructs a transition to the first operation state or a transition to the second operation state. The logic circuit 46 may substantially make the transition to the first operation state when the notification received last instructs the transition to the first operation state, and the result of the determining performed by the determining circuit 45 indicates the first period, and may substantially make the transition to the second operation state when the notification received last instructs the transition to the second operation state, and the result of the determining performed by the determining circuit 45 indicates the second period.

According to this configuration, it is possible to prevent the above-described false operations even when a condition for a state transition includes both the notification from outside and the period of the communication frame. In other words, it is possible to prevent processing a video signal as data other than a video signal and processing data other than a video signal as a video signal, due to a gap of the timing of a notification from outside or a gap of a state transition between the semiconductor devices.

Here, the logic circuit 46 may discard the plurality of communication frames received by the receiving circuit 42 when the notification received last instructs the transition to the first operation state, and the result of the determining performed by the determining circuit 45 does not indicate the first period, and may discard the plurality of communication frames received by the receiving circuit 42 when the notification received last instructs the transition to the second operation state, and the result of the determining performed by the determining circuit 45 does not indicate the second period.

Here, the semiconductor device 40 may control (i) a row-drive circuit (gate drive circuit 12*a*) which drives the display panel including a plurality of pixels arranged in rows and columns, on a pixel-row basis, and (ii) a column-drive circuit (source drive circuit 14) which drives the display panel on a pixel-column basis.

Here, the semiconductor device 40 may be a field programmable gate array (FPGA).

In addition, a display apparatus according to an aspect of the present disclosure includes: a first semiconductor chip that is the semiconductor device 40; a second semiconductor chip (semiconductor device 50) which transmits the plurality of communication frames unidirectionally to the first semiconductor chip; a microcomputer 30 which outputs a notification instructing a transition to the first operation state or a transition to the second operation state, to the first semiconductor chip and the second semiconductor chip; a display panel including a plurality of pixels arranged in rows and columns; a row-drive circuit 12*a* which is controlled by the first semiconductor chip and drives a pixel row of the display panel; and a column-drive circuit 14 which is controlled by the first semiconductor chip and drives a pixel column of the display panel, wherein the second semiconductor chip transmits the plurality of communication frames with the first period after receiving the notification instructing the transition to the first operation state, and transmits the plurality of communication frames with the second period after receiving the notification instructing the transition to the second operation state.

According to this configuration, since a state transition is made according to whether a period of the synchronization code included in the received communication frame is the first period or the second period, it is possible to prevent a false operation of processing a communication frame of the second period in the first operation state, and prevent a false operation of processing a communication frame of the first period in the second operation state.

Here, the logic circuit 46 may substantially make the transition to the first operation state when the notification received last instructs the transition to the first operation state, and the result of the determining performed by the determining circuit 45 indicates the first period, and may substantially make the transition to the second operation state when the notification received last instructs the transition to the second operation state, and the result of the determining performed by the determining circuit 45 indicates the second period.

According to this configuration, it is possible to prevent the above-described false operations even when a condition for a state transition includes both the notification from outside and the period of the communication frame.

(Modification)

Although the semiconductor device and the display apparatus using the semiconductor device have been described above based on the embodiment, the present disclosure is not limited to the above-described embodiment. Other forms in which various modifications apparent to those skilled in the art are applied to the embodiment, or forms structured by combining structural elements of different embodiments may be included within the scope of one or more aspects of the present disclosure, unless such changes and modifications depart from the scope of the present disclosure.

Therefore, the structural elements described in the accompanying drawings and detailed description include, not only the structural elements essential to solving the problem, but also the structural elements that are not essential to solving the problem but are included in order to exemplify the aforementioned technique. As such, description of these non-essential structural elements in the accompanying drawings and the detailed description should not be taken to mean that these non-essential structural elements are essential.

Furthermore, since the foregoing embodiment is for exemplifying the technique according to the present disclosure, various changes, substitutions, additions, omissions, and so on, can be carried out within the scope of the Claims or its equivalents.

For example, the following configurations may be included.

(1) In the embodiment, an example of the transmission line 60 which is a pair of differential signal lines 60*p* and 60*n* is described. However, the transmission line 60 may be a plurality of pairs of differential signal lines.

(2) The transmission interface between the semiconductor devices 40 and 50 may be a communication system other than a communication system using a differential signal.

(3) In the embodiment, an example of the unidirectional communication from the semiconductor device 50 to the semiconductor device 40 is described. However, a bidirectional communication may be employed.

(4) In the embodiment, the conditions of a state transition for the semiconductor device 40 include two items; a notification from the microcomputer 30 and a period of the communication frame. However, only the period of the communication frame may be the condition for a state transition.

(5) In the embodiment, an example of which each of the semiconductor device 40 and the semiconductor device 50 has the first operation state and the second operation state. However, three or more operation states may be held by each of the semiconductor device 40 and the semiconductor device 50. In addition, in at least two out of the three or more operation states, communication frames of mutually different periods may be used.

INDUSTRIAL APPLICABILITY

The present disclosure is applicable to a semiconductor device which controls a display panel substrate of a flat panel display apparatus such as a television receiver and an information device, and a display apparatus using the semiconductor device.

REFERENCE SIGNS LIST

1 Display apparatus
12*a*, 12*b* Gate drive circuit
14 Source drive circuit
16 Pixel circuit
20 Display panel substrate
30 Microcomputer
33 Control unit
35 Bus
40, 50 Semiconductor device
42 Receiving circuit
43 Detecting circuit
44 Measuring circuit
45 Determining circuit
46 Logic circuit
60 Transmission line

The invention claimed is:

1. A semiconductor device which controls display of a display panel, the semiconductor device comprising:

a receiving circuit which receives a plurality of communication frames, each of the plurality of communication frames being transmitted with a first period or a second period different from the first period, and including a synchronization code and data;

a logic circuit configured to operate in two operation states, the two operation states including a first operation state and a second operation state, in the first operation state, one or more communication frames of the first period received by the receiving circuit are each processed as data other than a digital video signal, wherein the data other than the video signal include control data from the semiconductor device and dummy data attached to a payload of a respective communication frame of the one or more communication frames, and in the second operation state, one or more communication frames of the second period received by the receiving circuit are each processed as the digital video signal;

a detecting circuit which detects the synchronization code from each of the plurality of communication frames received by the receiving circuit;

a measuring circuit which measures a period of the synchronization code detected in each of the plurality of communication frames, the period of the synchronization code either corresponding to the first period or the second period; and a determining circuit which determines whether the period of the synchronization code measured corresponds to the first period or the second period, wherein the logic circuit transitions to the first operation state or the second operation state based on whether the period of the synchronization code measured corresponds to the first period or the second period, wherein the receiving circuit receives at least one frame in a previous operation state even after an operation state has been changed to a new operation state at the receiving circuit.

2. The semiconductor device according to claim 1, wherein the semiconductor device receives a notification from outside, the notification instructing a transition to the first operation state or a transition to the second operation state, when the notification received last instructs the transition to the first operation state, and the result of the determining performed by the determining circuit indicates the first period, the logic circuit transitions to the first operation state, and when the notification received last instructs the transition to the second operation state, and the result of the determining performed by the determining circuit indicates the second period, the logic circuit transitions to the second operation state.

3. The semiconductor device according to claim 1, wherein when a notification received last instructs the transition to the first operation state, and the result of the determining performed by the determining circuit does not indicate the first period, the logic circuit discards, without processing, the plurality of communication frames received by the receiving circuit, and when the notification received last instructs the transition to the second operation state, and the result of the determining performed by the determining circuit does not indicate the second period, the logic circuit discards, without processing, the plurality of communication frames received by the receiving circuit.

4. The semiconductor device according to claim 1, wherein the semiconductor device controls (i) a row-drive circuit which drives the display panel including a plurality of pixels arranged in rows and columns, on a pixel-row basis, and (ii) a column-drive circuit which drives the display panel on a pixel-column basis.

5. The semiconductor device according to claim 1, wherein the semiconductor device is a field programmable gate array (FPGA).

6. The semiconductor device according to claim 1, wherein when, an instruction to transition from the first operation state to the second operation state is received by the logic circuit during processing of the communication frames in the first operation state, the logic circuit discards, without processing, communication frames of the first operation state received after receiving of the instruction to switch to the second operation state.

7. The semiconductor device according to claim 6, wherein when, an instruction to transition from the second operation state to the first operation state is received by the logic circuit during processing of the communication frames in the second operation state, the logic circuit discards, without processing, communication frames of the second operation state received after receiving of the instruction to switch to the first operation state.

8. A display apparatus comprising:

a first semiconductor chip that is the semiconductor device according to claim 1;

a second semiconductor chip which transmits the plurality of communication frames unidirectionally to the first semiconductor chip;

a microcomputer which outputs, to the first semiconductor chip and the second semiconductor chip, a notification instructing a transition to the first operation state or a transition to the second operation state;

a display panel including a plurality of pixels arranged in rows and columns;

a row-drive circuit which is controlled by the first semiconductor chip and drives a pixel row of the display panel; and a column-drive circuit which is controlled by the first semiconductor chip and drives a pixel column of the display panel, wherein the second semiconductor chip transmits the plurality of communication frames with the first period after receiving the notification instructing the transition to the first operation state, and transmits the plurality of communication frames with the second period after receiving the notification instructing the transition to the second operation state.

9. The display apparatus according to claim 8, wherein when the notification received last instructs the transition to the first operation state, and the result of the determining performed by the determining circuit indicates the first period, the logic circuit transitions to the first operation state, and when the notification received last instructs the transition to the second operation state, and the result of the determining performed by the determining circuit indicates the second period, the logic circuit transitions to the second operation state.

* * * * *